US006955577B1

(12) United States Patent
Hall

(10) Patent No.: US 6,955,577 B1
(45) Date of Patent: Oct. 18, 2005

(54) KICKBOARD WITH DRAG INDUCING CHANNEL

(76) Inventor: Stephen J. Hall, 17335 29th Avenue, Surrey, Bristish Columbia (CA) V3S 0E8

( * ) Notice: Subject to any disclaimer, the term of this patent is extended or adjusted under 35 U.S.C. 154(b) by 0 days.

(21) Appl. No.: 10/807,098

(22) Filed: Mar. 24, 2004

(51) Int. Cl.[7] ..... B63B 35/79; A63B 31/00
(52) U.S. Cl. ..... 441/74; 441/65; 482/55
(58) Field of Search ..... 441/55, 65, 71, 441/74, 79, 129; 114/39.15, 140; 434/254; 472/129; 482/55; D21/778, 803

(56) References Cited

U.S. PATENT DOCUMENTS

| | | | | |
|---|---|---|---|---|
| 2,536,390 | A | 1/1951 | Poboohenko | |
| 3,103,673 | A * | 9/1963 | Martin, Jr. | 441/68 |
| 3,255,472 | A * | 6/1966 | Thorne | 441/71 |
| 3,517,930 | A | 6/1970 | Jacobsen | |
| 3,945,068 | A | 3/1976 | Carbonero | |
| 4,071,236 | A | 1/1978 | Oprean | |
| 4,074,904 | A | 2/1978 | Arcidiacono | |
| 4,302,007 | A | 11/1981 | Oprean | |
| 4,302,860 | A | 12/1981 | Puch | |
| 4,362,518 | A | 12/1982 | Boissiere | |
| 4,406,628 | A | 9/1983 | Rademacher | |
| 4,507,094 | A * | 3/1985 | Hennebutte | 441/65 |
| 4,518,364 | A | 5/1985 | Jacobson | |
| 4,538,540 | A | 9/1985 | Cashmere | |
| 4,781,638 | A | 11/1988 | Winters, Jr. | |
| D300,446 | S | 3/1989 | Winters, Jr. | |
| 5,002,268 | A | 3/1991 | Anderson | |
| 5,011,137 | A | 4/1991 | Murphy | |
| 5,030,151 | A | 7/1991 | Beacham | |
| 5,080,620 | A * | 1/1992 | Reden | 441/68 |
| 5,106,331 | A | 4/1992 | Lizarazu | |
| 5,385,521 | A | 1/1995 | Weissbuch | |
| 5,472,391 | A | 12/1995 | Weissbuch | |
| 5,498,184 | A * | 3/1996 | Saghri | 441/65 |
| D369,636 | S | 5/1996 | Reeder | |
| 5,518,429 | A | 5/1996 | Gravlin | |
| 5,634,834 | A | 6/1997 | Cole et al. | |
| 5,643,154 | A | 7/1997 | Awbrey et al. | |
| 6,007,393 | A | 12/1999 | Choiniere et al. | |
| 6,050,925 | A | 4/2000 | Irvin et al. | |
| 6,089,935 | A * | 7/2000 | Fleming, III | 441/79 |
| 6,142,843 | A * | 11/2000 | Haase | 441/129 |
| D442,229 | S | 5/2001 | Chiang | |
| D446,569 | S | 8/2001 | Chiang | |
| D453,367 | S | 2/2002 | Katz | |
| 6,431,933 | B1 * | 8/2002 | Saghri | 441/65 |
| D466,175 | S | 11/2002 | Katz | |
| 6,533,625 | B1 * | 3/2003 | Taylor | 441/68 |
| 6,585,549 | B1 | 7/2003 | Fryar | |
| 6,767,266 | B2 * | 7/2004 | Bolen | 441/79 |
| 2002/0028619 | A1 | 3/2002 | Katz | |
| 2003/0143905 | A1 | 7/2003 | Katz | |

* cited by examiner

*Primary Examiner*—Andrew D. Wright
(74) *Attorney, Agent, or Firm*—Oyen Wiggs Green & Mutala LLP

(57) ABSTRACT

One aspect of the invention provides a drag-inducing kickboard. The kickboard has an undersurface. A funnel member projects from the undersurface and comprises at least one inner surface that is spaced apart from the undersurface to form a channel between the at least one inner surface of the funnel member and the undersurface of the kickboard. The funnel member is shaped to provide the channel with a front opening for allowing water into the channel and a rear opening for allowing water to escape from the channel. The front opening has a cross-sectional area that is greater than that of the rear opening.

29 Claims, 11 Drawing Sheets

KICKBOARD WITH DRAG INDUCING CHANNEL

TECHNICAL FIELD

The invention relates to kickboards. Particular embodiments of the invention are used by swimmers to train their legs and to improve the strength and power of their kicking stroke.

BACKGROUND

In training swimmers, particularly competitive swimmers, it has been recognized that the development of the muscles used in swimming ranks in importance with the swimmer's technique and cardiovascular conditioning. One method of developing the muscles used in swimming involves increasing the weight that the swimmer transports through the water and/or the resistance to the forward movement of the swimmer through the water when the swimmer is performing training laps. Resistance to the forward movement of a swimmer through the water is often referred to as drag. Increasing the drag experienced by a swimmer performing training laps strengthens the muscles used for swimming and reinforces the muscle movements used in swimming, thereby increasing the swimmers's endurance and power.

There are various techniques for increasing the drag experienced by a swimmer. Some of these techniques are disclosed in:

U.S. Pat. No. 3,945,068 to Carbonero;
U.S. Pat. No. 4,302,007 to Oprean;
U.S. Pat. No. 4,406,628 to Rademacher;
U.S. Pat. No. 4,781,638 to Winters Jr.;
U.S. Pat. No. 2,536,390 to Pobochenko;
U.S. Pat. No. 3,517,930 to Jacobsen;
U.S. Pat. No. 5,011,137 to Murphy;
U.S. Pat. No. 5,002,268 to Anderson; and
U.S. Pat. No. 4,074,904 to Arcidiacono.

A drawback common to many of these and other prior art techniques is that they do not permit the swimmer to isolate and train the muscles used in kicking. Kicking is a vitally important part of competitive swimming. Swimmers obtain much of their overall swimming power and speed from kicking. It is well recognized that isolating and training the muscles used in kicking strengthens the muscles used in kicking and allows the swimmer to concentrate on the muscle movements used in their kicking stroke, thereby increasing the endurance and power of the swimmer's kicking stroke and the swimmer's overall swimming speed.

The above-mentioned patents to Carbonero, Rademacher, Winters Jr. and Pobochenko disclose devices that the swimmer holds in their hands and/or arms, such that the swimmer may propel themselves by kicking. However, these devices require that the swimmer use different grips on the device to create drag or that the swimmer orient the device at a particular angle to create drag. Such devices have the drawback that they require the swimmer to maintain their arms and/or upper body in particular position(s) to cause the device to create a constant amount of drag. Such particular arm and/or upper body position(s) often do not permit a full kicking stroke and are therefore not conducive to isolating and training the muscles used in kicking. An additional drawback with these types of devices is that there is a tendency for the drag created by the device to vary if the swimmer does not maintain a desired grip or a desired device orientation.

Accordingly, there is a general desire to provide a drag-creating device for use by a swimmer which allows the swimmer to isolate and train the muscles used in kicking and which ameliorates some of the aforementioned drawbacks with the prior art.

SUMMARY OF THE INVENTION

A first aspect of the invention provides a drag-inducing kickboard apparatus. The apparatus comprises a kickboard and a funnel member disposed below an undersurface of the kickboard. The funnel member defines, either itself or in combination with the undersurface of the kickboard, a channel having one or more front openings for allowing water into the channel and one or more rear openings for allowing water to escape from the channel. The one or more front openings have a total cross-sectional area that is greater than a total cross-sectional area of the one or more rear openings.

The funnel member may comprise at least one inner surface that is spaced apart from the undersurface of the kickboard to define the channel between the at least one inner surface of the funnel member and the undersurface of the kickboard.

The funnel member may be sufficiently rigid to maintain a shape of the channel when the funnel member is wet and there is no flow of water through the channel. The funnel member may also be sufficiently rigid to maintain the shape of the channel when there is a flow of water through the channel created by a human swimmer.

The funnel member and the kickboard may be integrally formed. The funnel member may alternatively be formed separately from the kickboard and subsequently coupled to the kickboard. Each transverse side of the funnel member may comprise one or more flanges which extend along the undersurface of the kickboard. The funnel member may be coupled to the kickboard by one or more fasteners which project through the flanges and into the kickboard. The funnel member may be coupled to the undersurface of the kickboard by adhesive applied between the one or more flanges and the undersurface of the kickboard. The funnel member may be welded to the undersurface of the kickboard.

The apparatus may comprise a plurality of funnel members. Each funnel member may comprise at least one corresponding inner surface that is spaced apart from the undersurface to define a corresponding channel between the at least one corresponding inner surface of the funnel member and the undersurface of the kickboard. Each funnel member may be shaped to provide its corresponding channel with one or more front openings for allowing water into the corresponding channel and one or more rear openings for allowing water to escape from the corresponding channel. For each funnel member, the one or more front openings may have a total cross-sectional area that is greater than a total cross-sectional area of the one or more rear openings.

The apparatus may comprise a plurality of funnel members. Each funnel member may define, either itself or in combination with the undersurface of the kickboard, a corresponding channel having one or more front openings for allowing water into the corresponding channel and one or more rear openings for allowing water to escape from the corresponding channel. For each funnel member, the one or more front openings may have a total cross-sectional area that is greater than a total cross-sectional area of the one or more rear openings.

The at least one inner surface of the funnel member may have a curved cross-sectional profile. The channel may have a generally rectangular cross-sectional profile. The channel may have a generally triangular cross-sectional profile.

The funnel member may comprise a rear surface located rearward of the one or more front openings. The one or more rear openings may penetrate the rear surface. The cross-sectional area of the channel may be substantially constant between the one or more front openings and the rear surface. The funnel member may comprise a front surface. The one or more front openings may penetrate the front surface.

The undersurface of the kickboard may be substantially flat. The undersurface of the kickboard may alternatively have a curved profile.

The cross-sectional area of the channel may decrease monotonically between the one or more front openings and the one or more rear openings.

The funnel member may be fabricated from one or more of: plastic, foam, rubber and neoprene. The funnel member may comprise a relatively flexible material and a plurality of relatively rigid braces which are coupled to the relatively flexible material. The funnel member may comprise one or more inflatable cells which may be inflated with air.

The total cross-sectional area of the front openings may be in a range of 3–45 square inches or in a narrower range of 8–24 square inches. The total cross-sectional area of the rear openings may be in a range of 1–20 square inches or in a narrower range of 3–12 square inches.

Another aspect of the invention provides a kit for providing a kickboard with increased drag. The kit comprises a funnel member that is coupleable to a kickboard. When coupled to the kickboard, the funnel member defines, either itself or in combination with an undersurface of the kickboard, a channel having one or more front openings for allowing water into the channel and one or more rear openings for allowing water to escape from the channel. The one or more front openings have a total cross-sectional area that is greater than a total cross-sectional area of the one or more rear openings.

Another aspect of the invention provides a method for increasing the drag provided by a kickboard. The method comprises: providing a funnel member with at least one inner surface and coupling the funnel member to the kickboard in such a manner that the funnel member, either itself or in combination with an undersurface of the kickboard, defines a channel having one or more front openings for allowing water into the channel and one or more rear openings for allowing water to escape from the channel. The one or more front openings have a total cross-sectional area that is greater than a total cross-sectional area of the one or more rear openings.

Another aspect of the invention provides a method of training swimmers using kickboards equipped with the funnel members described above. The swimmers may train their legs and kicking stroke or may individually train their arms and arm stroke.

Another aspect of the invention provides kickboard apparatus comprising a buoyant kickboard and a means for increasing a drag provided by the kickboard when the kickboard is propelled through water. The means for increasing drag provides at least one channel having a forward facing inlet and at least one outlet located rearward of the inlet.

Further features and applications of specific embodiments of the invention are described below.

BRIEF DESCRIPTION OF THE DRAWINGS

In drawings which depict non-limiting embodiments of the invention.

DETAILED DESCRIPTION

Figure 1:
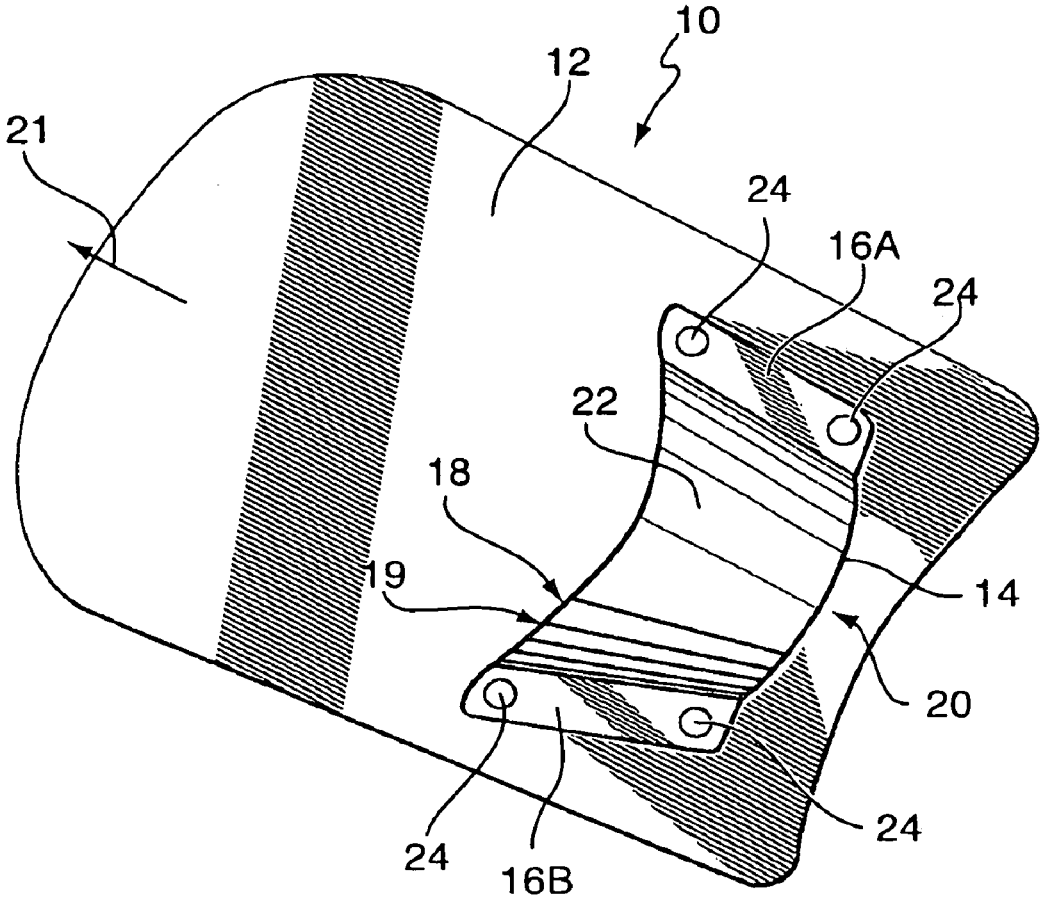
FIG. 1 is an isometric view of a kickboard according to one embodiment of the invention.
Figure 2:
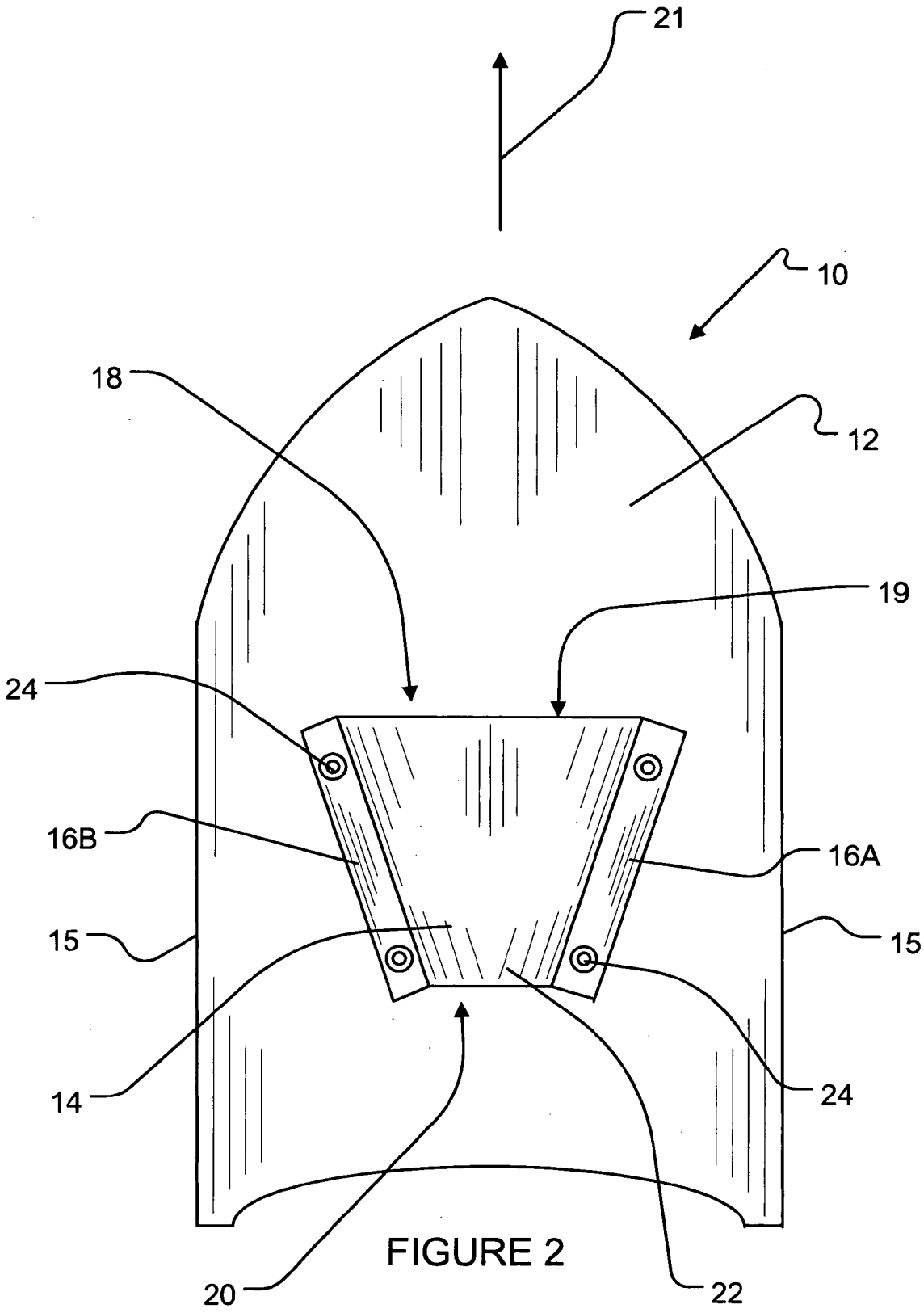
FIG. 2 is an bottom plan view of the FIG. 1 kickboard.
Figure 3:
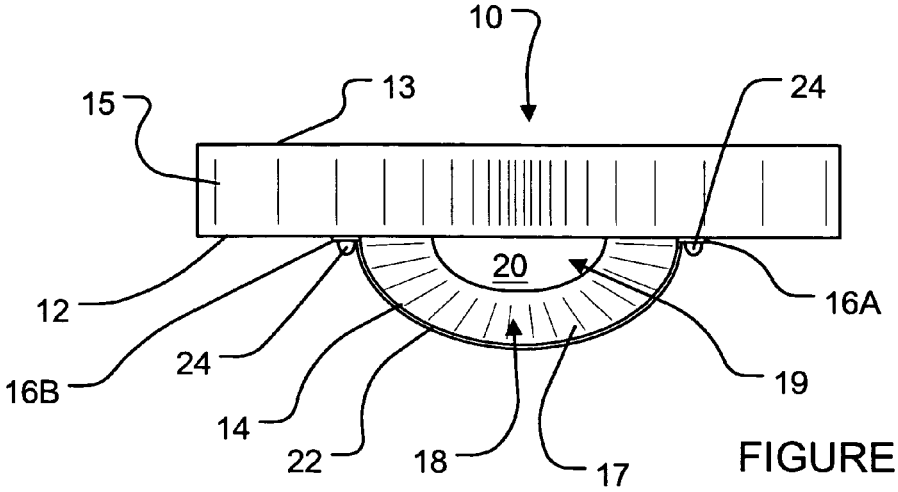
FIG. 3 is a front plan view of the FIG. 1 kickboard.
Figure 4:
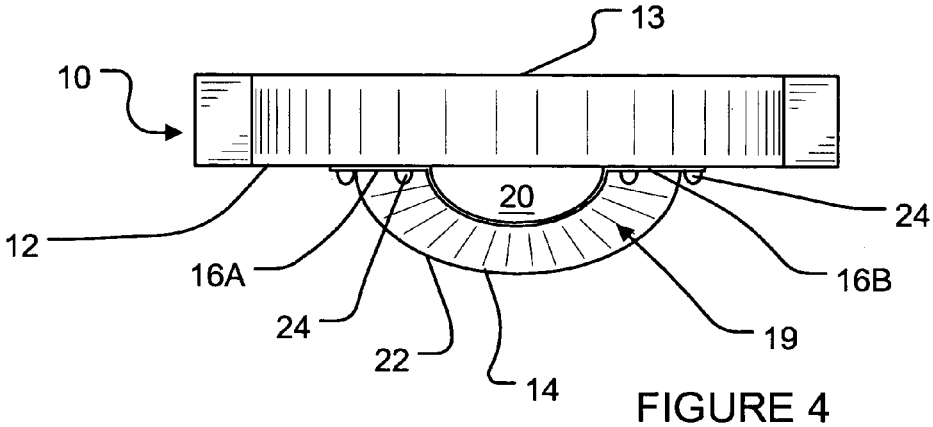
FIG. 4 is a rear plan view of the FIG. 1 kickboard.
Figure 5:
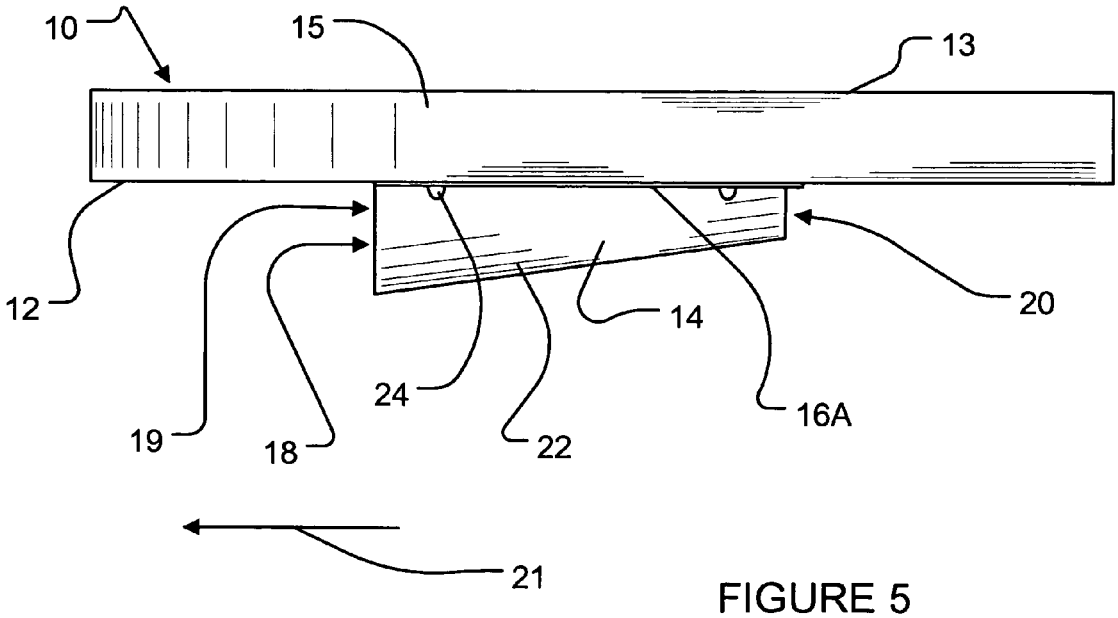
FIG. 5 is a side plan view of the FIG. 1 kickboard.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Some embodiments of this invention relate to a kickboard having one or more funnel members which provide the kickboard with increased drag. In some embodiments, each drag-inducing funnel member is coupled to the kickboard at least when the kickboard is in use to form a channel between an undersurface of the kickboard and an inner surface of the funnel member. In some embodiments, the funnel member is integrally formed with the kickboard to form a channel between the undersurface of the kickboard and the inner surface of the funnel member. In other embodiments, the body of the funnel member defines a channel independently of the kickboard and the funnel member is coupled to the kickboard at least when the kickboard is in use, such that the channel may be positioned under the undersurface of the kickboard. The channel formed by the funnel member has a front opening with a larger cross-sectional area than that of its rear opening.

Kickboards are typically used to provide buoyancy for a swimmer's upper body while the swimmer propels him or herself through the water by kicking. Kickboards in accordance with the invention may be used by competitive and recreational swimmers to train their legs and to improve the strength, speed, technique, power and/or other aspects of the swimmer's kicking stroke. In such applications, a swimmer rests their arms and/or upper body on the kickboard and kicks to propel him or herself forward. The cross-sectional area of the front opening of the channel is larger than the cross-sectional area of the rear opening of the channel. Accordingly, as the kickboard moves through the water, the cross-sectional area through which water enters the channel is larger than the cross-sectional area of the opening through which water exits the channel. As a result, the funnel member creates drag which is experienced by the swimmer as the swimmer kicks to propel him or herself through the water. A kickboard providing such drag facilitates isolation and training of the muscles used in kicking. In an alternative application, kickboards in accordance with the invention may be used by swimmers to individually train their arm strokes by resting one of their arms on the kickboard and stroking with their other arm to propel themselves through the water.

Preferably, the funnel member is sufficiently rigid to maintain its shape during regular use, such that, for a given speed of forward movement through the water, the drag created by the funnel member is substantially constant.

A kickboard 10 according to one embodiment of the invention is shown in FIGS. 1–5. Kickboard 10 is buoyant and has a relatively flat undersurface 12. Kickboard 10 may, for example, comprise a conventional kickboard made of rigid or semi-rigid foam material. A drag-creating funnel member 14 is coupled to kickboard 10 to form a channel 19 between an inner surface 17 (FIG. 3) of funnel member 14 and undersurface 12 of kickboard 10. Funnel member 14 comprises a pair of flanges 16A, 16B located on transverse sides of a curved central portion 22.

Funnel member 14 may be coupled to undersurface 12 using fasteners 24, which project through flanges 16A, 16B and into kickboard 10. Fasteners 24 may generally be any type of permanent or removable fastener, such as staples, rivets and threaded fasteners, for example. In some embodiments, fasteners 24 extend through to a top surface 13 of kickboard 10. In some embodiments, funnel member 14 is coupled to other parts of kickboard 10 (eg. top surface 13 or edges 15). In other embodiments, funnel member 14 is coupled to kickboard 10 using tape, glue or some other suitable adhesive. In still other embodiments, funnel member 14 is coupled to kickboard 10 by a suitable welding process. In general, funnel member 14 may be coupled to kickboard 10 using any technique which facilitates the functionality described herein.

Central portion 22 of funnel member 14 has a curved cross-sectional profile that is convex in shape, such that its inner surface 17 is spaced apart from undersurface 12 to form channel 19 between inner surface 17 of funnel member 14 and undersurface 12 of kickboard 10. The shape of central portion 22 provides channel 19 with a front opening 18 that has a cross-sectional area larger than that of its rear opening 20. In the illustrated embodiment, central portion 22 is also shaped such that the cross-sectional area of channel 19 decreases monotonically from front to rear.

In use, a swimmer (not shown) can position his or her arms and/or upper body on the top surface 13 of kickboard 10 and grip kickboard 10 on top surface 13 and/or along one or more of its edges 15. The swimmer then propels him or herself in a forward direction (i.e. in the general direction indicated by arrow 21) through the water by kicking. As the swimmer moves forward, water flows into channel 19 through the relatively large cross-sectional area of front opening 18, through the increasingly smaller cross-sectional area of channel 19 and out from channel 19 through the relatively small cross-sectional area of rear opening 20. Because of the relative sizes of front opening 18 and rear opening 20, the water flowing through channel 19 creates drag when the swimmer is moving forward. Accordingly, swimmers using kickboard 10 are forced to kick with increased muscular effort to overcome the drag created by funnel member 14, thereby isolating and training the muscles used in kicking.

As discussed above, the cross-sectional area of front opening 18 is greater than the cross-sectional area of rear opening 20 to provide drag. The amount of drag experienced by a swimmer using kickboard 10 in the manner described above will typically depend on the ratio of the cross-sectional size of front opening 18 to the cross-sectional size of rear opening 20. In general, if this ratio is larger, the drag will be greater and, conversely, if this ratio is smaller, the drag will be less. In some preferred embodiments, front opening 18 has a cross-sectional area in a range of 3–45 square inches and rear opening 20 has a cross-sectional area in a range of 1–20 square inches. In particularly preferred embodiments, front opening 18 has a cross-sectional area in a range of 8–24 square inches and rear opening 20 has a cross-sectional area in a range of 3–12 square inches.

Preferably, funnel member 14 is sufficiently rigid to maintain its shape when it is wet and there is no flow of water through channel 19. In other words, when kickboard 10 is wet or immersed in water, the weight of the water preferably will not change the shape of funnel member 14. Funnel member 14 is also preferably sufficiently rigid to maintain its shape during use (i.e. when exposed to the forces that may be applied to funnel member 14 by water during use of kickboard 10 by a human swimmer). The rigidity of funnel member 14 is advantageous, because, in use, funnel member 14 provides a relatively constant drag for a given speed of forward movement. To avoid injury, however, funnel member 14 is also preferably at least moderately resiliently deformable, such that it may be deformed by a swimmer whose body contacts funnel member 14.

In the illustrated embodiment of FIGS. 1–5, funnel member 14 is fabricated from a material that has the desired rigidity to maintain the shape of funnel member 14 when in use by a human swimmer and the desired resilient deformability to avoid injury. Examples of suitable materials for funnel member 14 and kickboard 10 include, without limitation: plastic (e.g. various forms of polyethylene and polypropylene, polyvinyl chloride, urethane), foam (e.g. ethyl vinyl acetate, polyethylene, polystyrene), rubber, neoprene, wood and various types of fabrics.

In other embodiments (discussed further below), funnel member 14 is fabricated from a relatively flexible material and one or more relatively rigid braces are coupled to the flexible material. The braces are preferably sufficiently rigid to maintain the shape of funnel member 14 when in use by a human swimmer, but are preferably moderately resiliently deformable to avoid injury.

In still other embodiments, funnel member 14 and/or kickboard 10 are fabricated from relatively flexible material which comprises one or more air chambers. Air chambers in funnel member 14 may be inflated with air to provide funnel member 14 with the desired rigidity and deformability characteristics. Air chambers in kickboard 10 may be inflated to provide kickboard 10 with the desired buoyancy characteristics.

Figure 6:
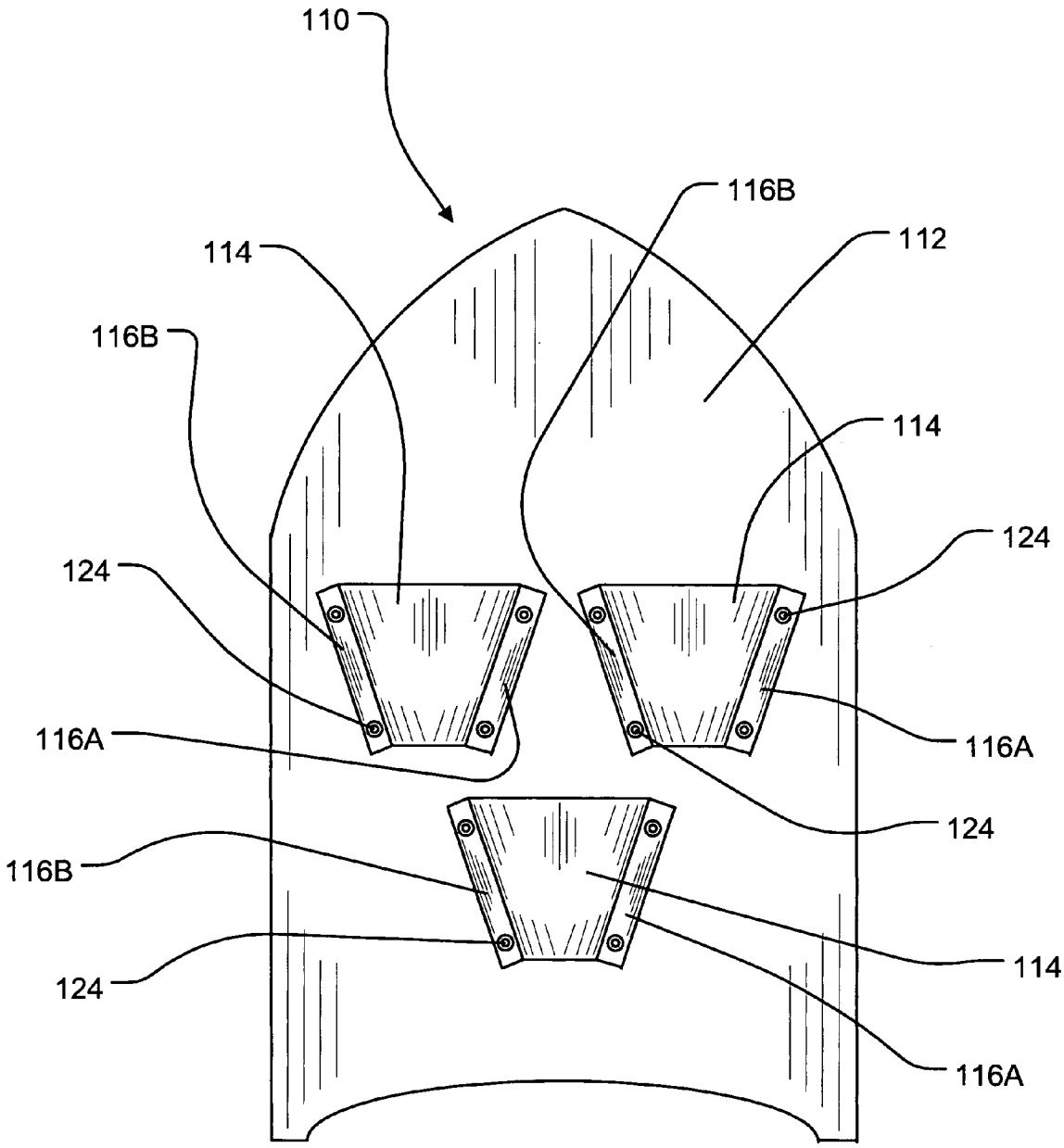
FIG. 6 is a bottom plan view of a kickboard according to another embodiment of the invention.

FIG. 6 depicts the undersurface 112 of a kickboard 110 according to a different embodiment of the invention, wherein kickboard 110 comprises a plurality of funnel members 114. Funnel members 114 are coupled to undersurface 112 at spaced apart locations using fasteners 124 which project through flanges 116A, 116B on transverse sides of funnel members 114.

In the illustrated embodiment of FIG. 6, each funnel member 114 of kickboard 110 is substantially similar. In other embodiments (not shown), individual funnel members 114 may differ in size, in the characteristics of their cross-sectional profile, in the way that they are coupled to kickboard 110 and/or in other characteristics. Those skilled in the art will appreciate that other embodiments of the invention described herein may also incorporate a plurality of funnel members.

Figure 7:
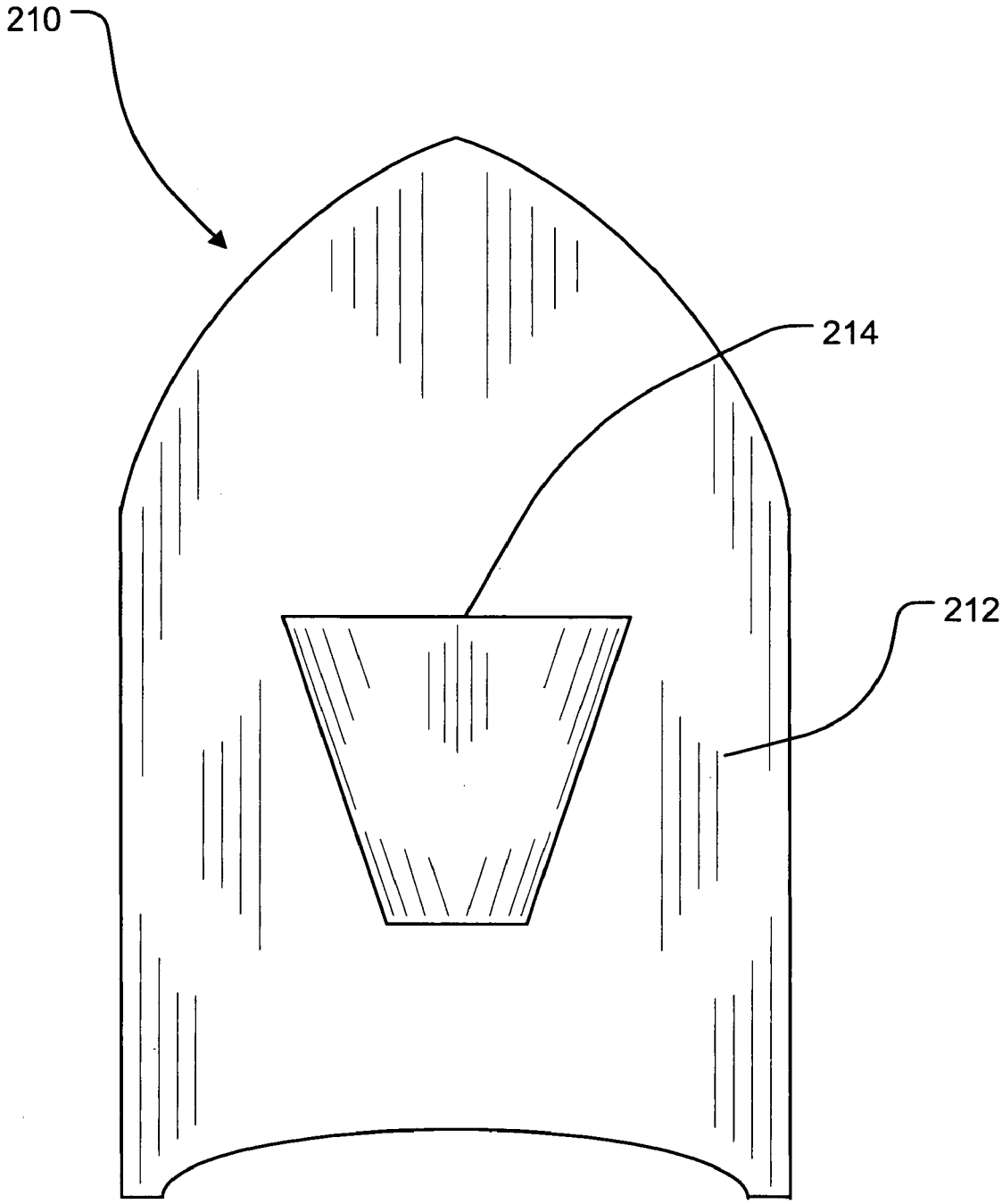
FIG. 7 is a bottom plan view of a kickboard according to another embodiment of the invention.

FIG. 7 depicts the undersurface 212 of a kickboard 210 according to a different embodiment of the invention, wherein funnel member 214 is integrally formed with kickboard 210. Those skilled in the art will appreciate that other embodiments of the invention described herein may also comprise funnel members that are integrally formed with their associated kickboards.

Figure 8A:
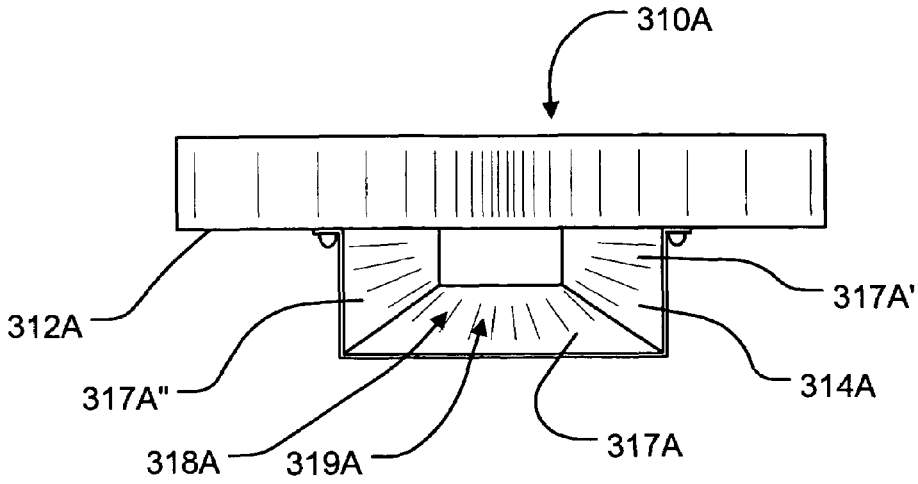
FIGS. 8A, 8B and 8C represent front plan views of kickboards according to further embodiments of the invention.
Figure 8B:
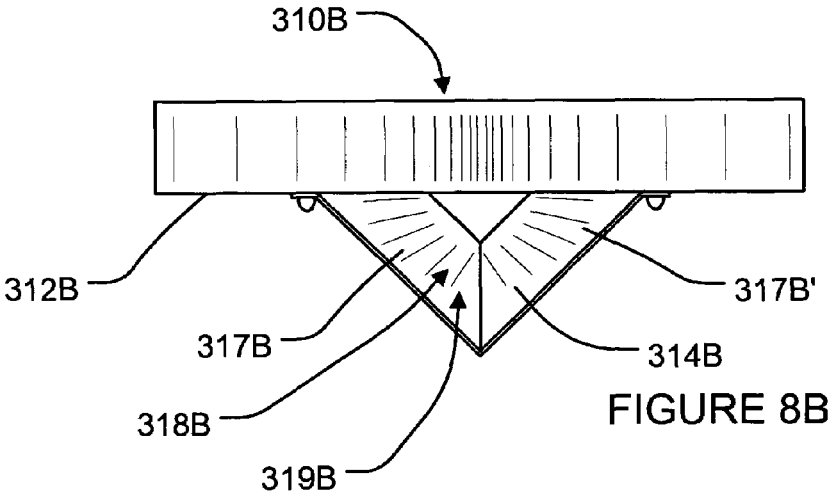

The embodiments described above incorporate funnel members which have a generally convex curved profile. In general, the invention should be understood to incorporate funnel members having other cross-sectional profiles. For example, FIG. 8A depicts a front plan view of a kickboard 310A comprising a funnel member 314A with a rectangular cross-sectional profile and FIG. 8B depicts a front plan view of a kickboard 310B comprising a funnel member 314B with a triangular cross-sectional profile. Channel 319A of kickboard 310A (FIG. 8A) is defined by the three inner surfaces 317A, 317A', 317A" of funnel member 314A and by undersurface 312A of kickboard 310A. Channel 319B of kickboard 310B (FIG. 8B) is defined by the two inner surfaces 317B, 317B' of funnel member 314B and by undersurface 312B of kickboard 310B.

In other alternative embodiments (not shown), funnel members according to the invention have other cross-sectional profiles, provided that the cross-sectional area of the front opening of the channel is greater than cross-sectional area of the rear opening of the channel. For example, a funnel member may be shaped to provide a channel with a rectangular front opening and a curved rear opening, provided that the cross-sectional area of the front opening of the channel is greater than the cross-sectional area of the rear opening of the channel. Those skilled in the art will appreciate that other embodiments of the invention described herein may incorporate funnel members having alternative cross-sectional shapes.

Figure 8C:
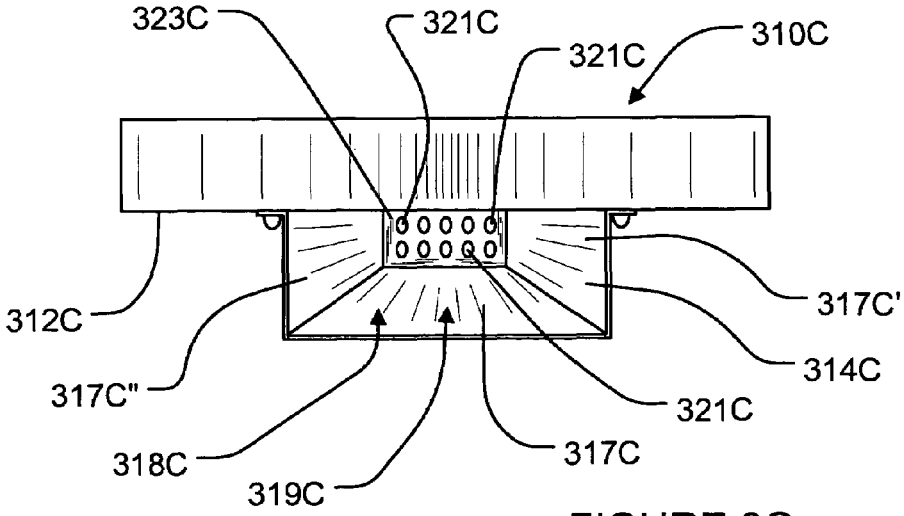

FIG. 8C depicts a front plan view of a kickboard 310C according to another alternative embodiment of the invention. Kickboard 310C comprises a funnel member 314C with a rectangular cross-sectional profile comprising inner surfaces 317C, 317C', 317C", which, together with undersurface 312C of kickboard 310C, define a channel 319C. The front opening 318C of channel 319C is a single opening. However, funnel member 314C comprises a rear surface 323C which is penetrated by a plurality of openings 321C. Accordingly, the rear opening of channel 319C is made up of a plurality of openings 321C which penetrate rear surface 323C. Those skilled in the art will appreciate that rear surface 323C and the rear openings 321 therein need not be located at the rearwardmost extent of funnel member 314C. In general, rear surface 323C and the rear openings 321 therein need only be rearward of front opening 320C.

Those skilled in the art will appreciate that other funnel member and kickboard embodiments described herein may comprise a plurality of front openings and/or a plurality of rear openings, provided that the total cross-sectional area of the front opening(s) of the channel is greater than the total cross-sectional area of the rear opening(s) of the channel. References in this description and the accompanying claims to the cross-sectional area of the front opening of the channel and the cross-sectional area of the rear opening of the channel should be understood to refer to the total cross-sectional area of all of the front openings and the total cross-sectional area of all of the rear openings.

Figure 9A:
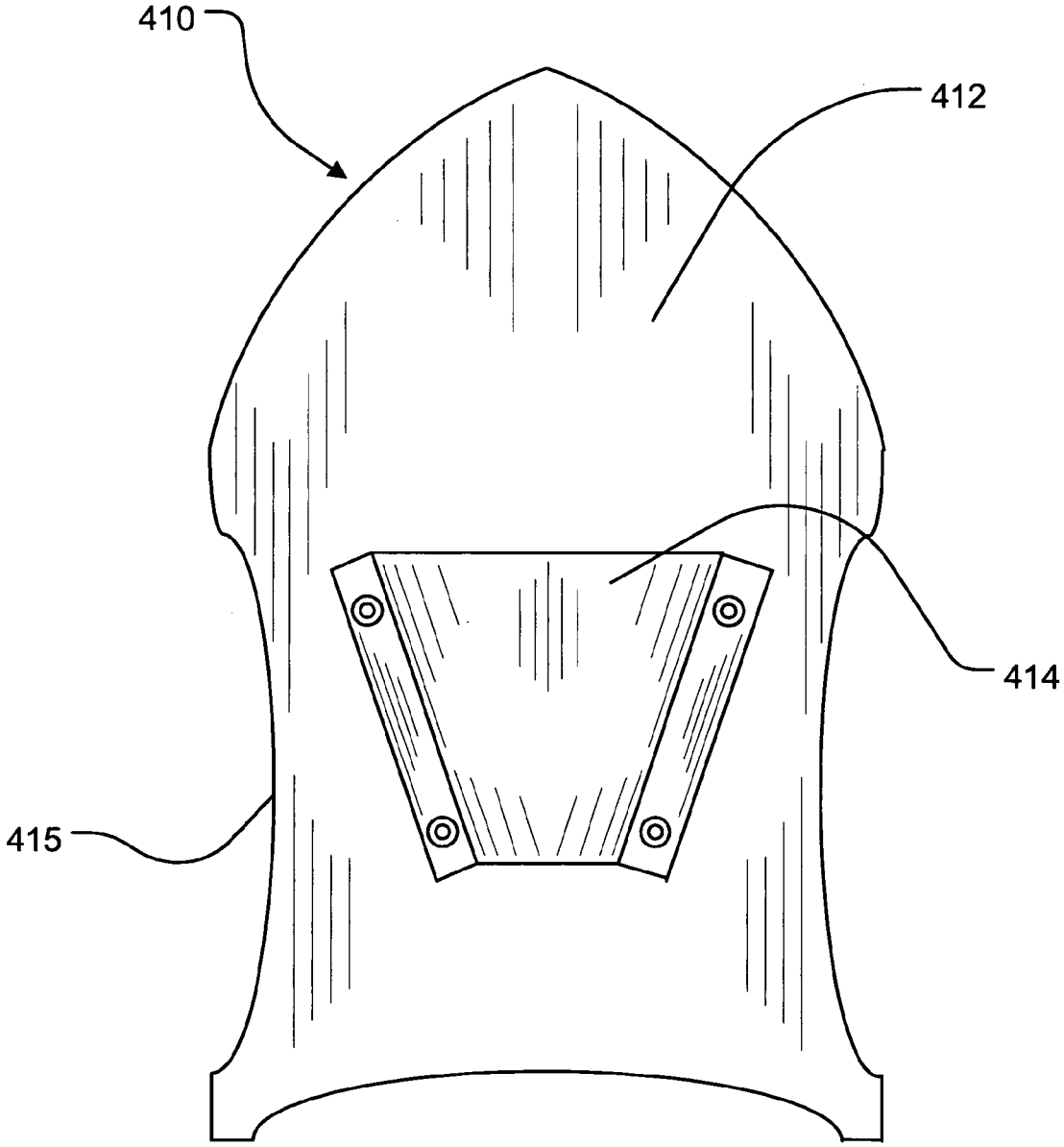
FIGS. 9A and 9B respectively depict bottom plan and front plan views of a kickboard according to yet another embodiment of the invention.
Figure 9B:
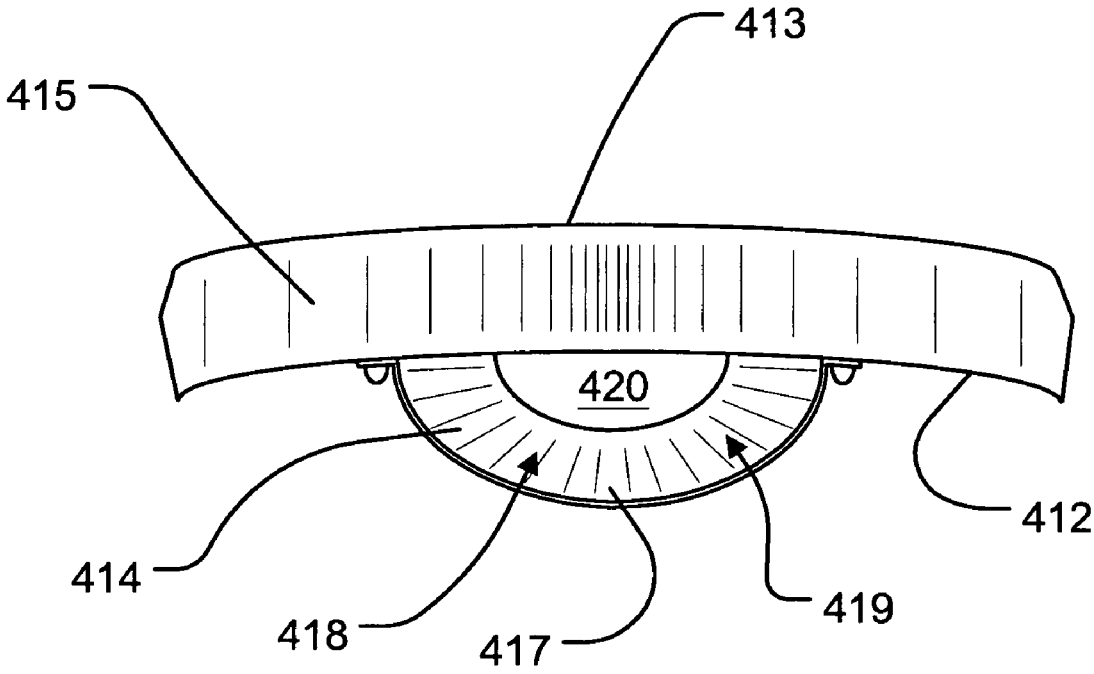

FIGS. 9A and 9B respectively depict bottom and front plan views of a kickboard 410 according to still another embodiment of the invention. The undersurface 412 and top surface 413 of kickboard 410 have curved profiles (i.e. rather than the generally flat profile of kickboard 10) and the edges 415 of kickboard 410 also have a curved ergonomic profile. In general, kickboards according to the invention may have virtually any shape. Those skilled in the art will appreciate that other embodiments of the invention described herein may incorporate kickboards having curved profiles or other shapes.

Figure 10A:
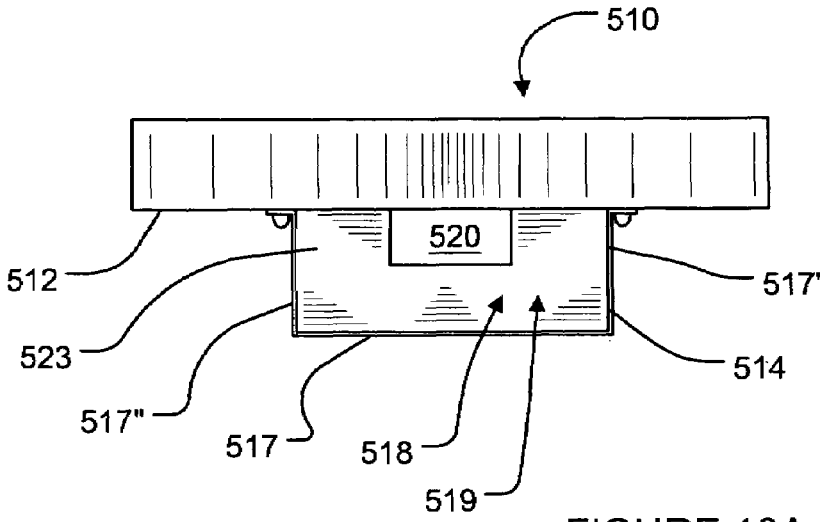
FIGS. 10A and 10B respectively depict front and side plan views of a kickboard according to another embodiment of the invention.
Figure 10B:
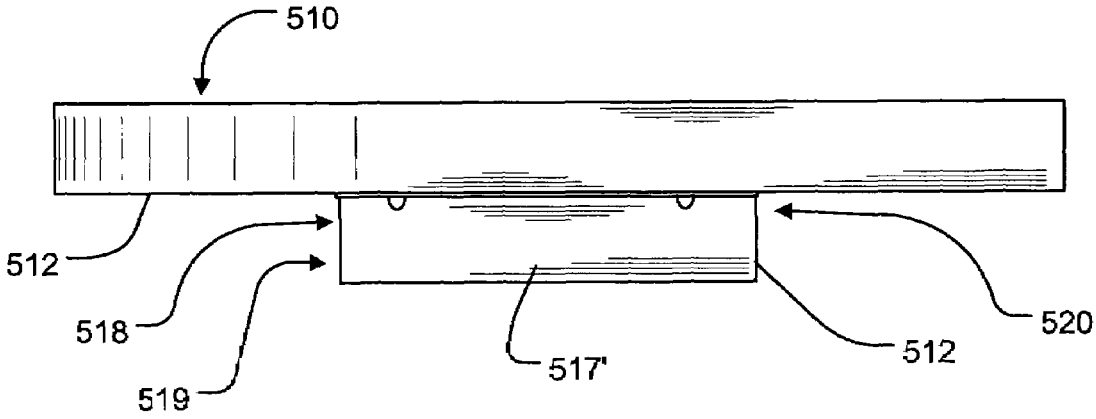

FIGS. 10A and 10B respectively depict front and side views of a kickboard 510 according to another alternative embodiment of the invention. Funnel member 514 forms a channel 519 between the undersurface 512 of kickboard 510 and inner surfaces 517, 517', 517". Channel 519 has a rectangular cross-section that is relatively constant in cross-sectional area between front opening 520 and rear surface 523. Rear surface 523 extends between inner surfaces 517, 517' and 517" and is penetrated by a rear opening 520. Rear opening 520 has a cross-sectional area which is smaller than that of front opening 518 and smaller than that of the rest of channel 519. The difference in the cross-sectional area of front opening 518 and rear opening 520 creates drag as described above. Funnel member 514 may be shaped to provide channel 519 with different cross-sectional shapes as described above. Those skilled in the art will appreciate that rear surface 523 and the rear opening 520 therein need not be located at the rearwardmost extent of funnel member 514. In general, rear surface 523 and the rear opening 520 therein need only be located rearward of front opening 520. Those skilled in the art will appreciate that other embodiments of the invention described herein may comprise a channel with a constant cross-sectional area and a rear surface penetrated by a rear channel opening that is smaller in cross-sectional area than the front channel opening.

Figure 11:
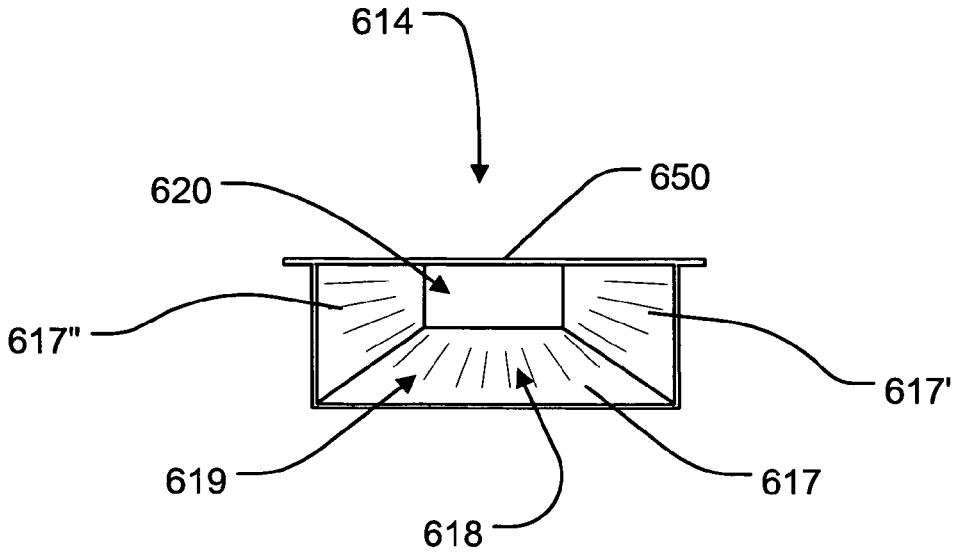
FIG. 11 depicts a front plan view of a funnel member according to another embodiment of the invention.

FIG. 11 depicts a funnel member 614 according to another alternative embodiment of the invention. Funnel member 614 comprises a bottom surface 617, a pair of side surfaces 617', 617" and a top surface 650, which define a channel 619 with a rectangular cross-sectional profile. Channel 619 comprises a front opening 618 and a rear opening 620. Funnel member 614 differs from the above-described embodiments in that channel 619 is completely defined by funnel member 619 (i.e. channel 619 is defined independently of the kickboard (not shown) to which it may be coupled).

In the embodiment of FIG. 11, top surface 650 of channel 619 abuts against the undersurface of the kickboard to which funnel member 614 may be coupled. Top surface 650 may be used to couple funnel member 614 to the kickboard using fasteners or any of the other techniques described above. In other embodiments, the channel 619 defined by funnel member 614 is spaced apart from the undersurface of the kickboard to which it may be coupled and need not abut against the undersurface of the kickboard. Those skilled in the art will appreciate that other embodiments of the invention described herein may be configured to incorporate channels that are defined independently of the kickboard to which they may be coupled.

Figure 12:
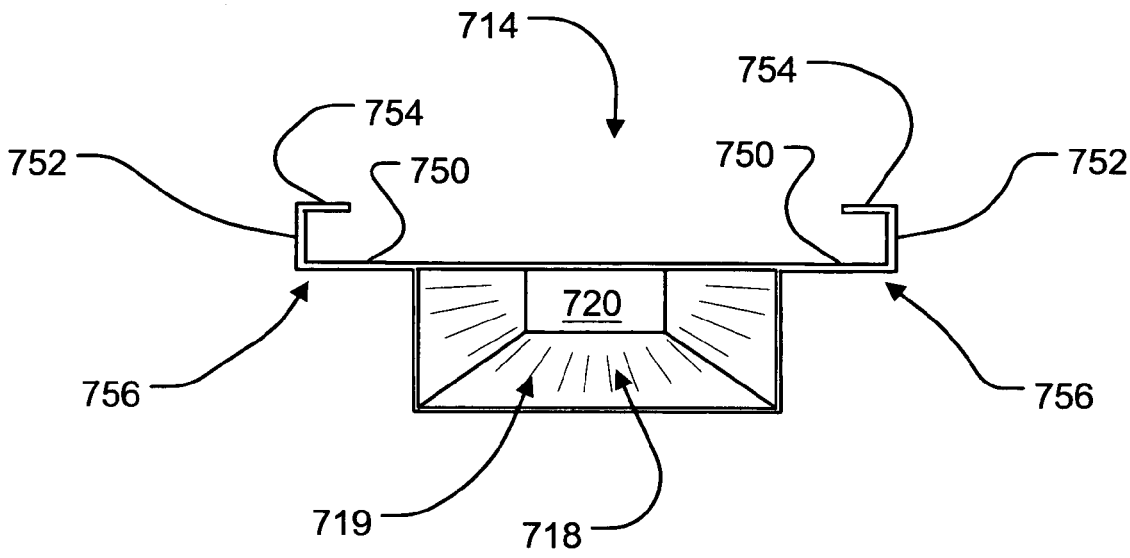
FIG. 12 depicts a front plan view of a funnel member according to yet another embodiment of the invention.

FIG. 12 depicts a funnel member 714 according to another alternative embodiment of the invention. Funnel member 714 is similar to funnel member 614 of FIG. 11 in that channel 719 is defined by funnel member 714 independently of the kickboard (not shown) to which it may be coupled. However, funnel member 714 also comprises "C-shaped" mounting flanges 756 on its transverse sides. In the illustrated embodiment, each mounting flange 756 comprise a bottom surface 750, a side surface 752 and a top surface 754. Funnel member 714 may be mounted to the kickboard with mounting flanges 756 extending around the side edges of the kickboard. Top surfaces 754 may abut against the top surface of the kickboard, side surfaces 752 may abut against the side surfaces of the kickboard, and bottom surface 750 may abut to the bottom surface of the kickboard. Mounting flanges 756 may be coupled to the kickboard using fasteners or any of the other techniques described above.

In other embodiments, mounting flanges 756 are made from material that is resiliently deformable, such that the surfaces of mounting flanges 756 are deformed when funnel member 714 is mounted to the kickboard. In this manner, the surfaces of mounting flanges 756 may form a friction fit with the corresponding surfaces of the kickboard. In still other embodiments, mounting flanges 756 are made from material that is resiliently deformable, such that the surfaces of mounting flanges 756 may be compressed against the corresponding surfaces of the kickboard by a person using the kickboard and gripping flanges 756. Those skilled in the art will appreciate that the other embodiments described herein may comprise funnel members which are provided with mounting flanges similar to mounting flanges 756.

Figure 13A:
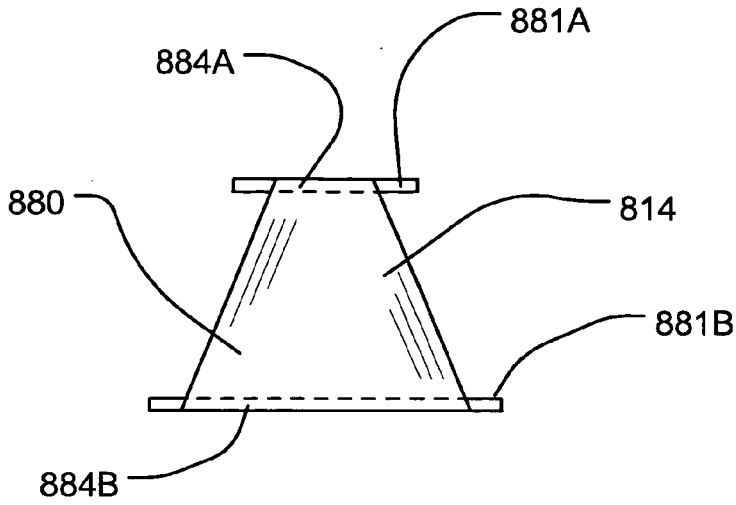
FIG. 13A depicts a top plan view of a funnel member according to another embodiment of the invention.
Figure 13B:
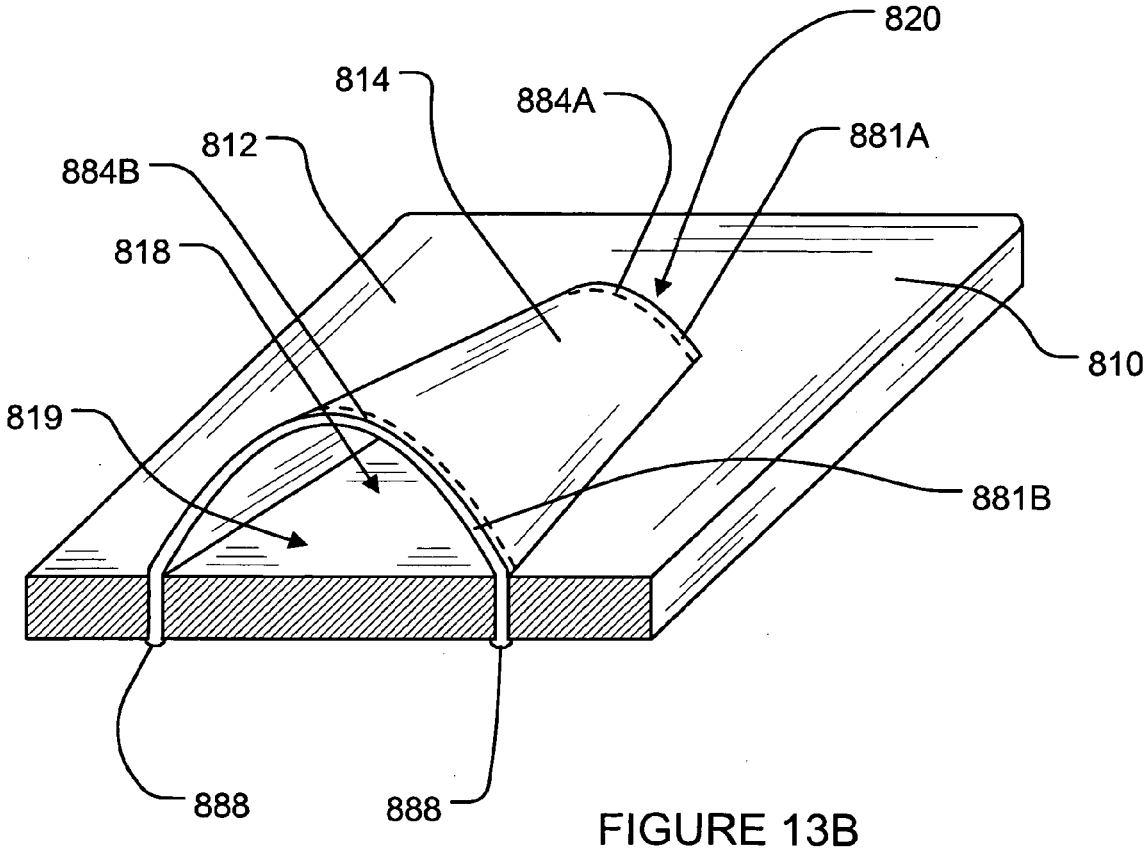
FIG. 13B depicts a partially sectioned isometric view of a kickboard incorporating the funnel member of FIG. 13A.

FIG. 13A depicts a top plan view of a funnel member 814 according to another embodiment of the invention. FIG. 13B is a partial cross-sectional isometric view showing one particular example of how funnel member 814 may be coupled to a kickboard 810. Funnel member 814 is fabricated from a relatively flexible material 880, such a neoprene or some type of fabric for example. Funnel member 814 also comprises one or more relatively rigid braces 881 which are coupled to flexible material 880. The illustrated embodiment of funnel member 814 comprises a pair of transversely extending braces 881A, 881B which are respectively coupled to the front and back ends of flexible material 880. In the illustrated embodiment, braces 881A, 881B are coupled to flexible material by extending through guide tubes 884A, 884B which are sewn into (or otherwise formed in) flexible material 880. Those skilled in the art will appreciate that there are many other ways to couple braces 881 to flexible material 880 which include the use of fasteners, adhesives, sewing and welding for example.

Braces 881 are relatively rigid in comparison to flexible material 880. However, braces 881 are also preferably moderately resiliently deformable. In the illustrated embodiment, braces 881 are flat in their undeformed state. Accordingly, funnel member 814 is also flat in its undeformed state. As shown in FIG. 13B, funnel member 814 is deformed and mounted to kickboard 810 to create a channel 819 between an undersurface 812 of kickboard 810 and an inner surface (not shown) of funnel member 814. Channel 819 has a front opening 818 and a rear opening 820. Front opening 818 has a larger cross-sectional area than rear opening 820 to provide drag as discussed above. In other embodiments, braces 881 and funnel member 814 may have different shapes in their undeformed states. For example, braces 881 and funnel member 814 may have the shape shown in FIG. 13B when they are in their undeformed state.

Preferably, braces 881 are sufficiently rigid to maintain the shape of flexible material 880 and funnel member 814 when kickboard 810 is in use by a human swimmer. However, braces 881 are also preferably moderately resiliently deformable to avoid injury if the swimmer's body contacts funnel member 814. In the illustrated embodiment of FIGS. 13A and 13B, funnel member 814 comprises a pair of transversely extending braces 881A, 881B which are respectively disposed at the front and rear ends of funnel member 814. In other embodiments, funnel member 814 may comprise different numbers of braces 881, which may extend transversely and/or in other directions to provide funnel member 814 with desired rigidity and deformability. In particular, funnel member 814 may comprise one or more longitudinally extending braces 881.

In the illustrated embodiment of FIG. 13B, funnel member 814 is coupled to kickboard 10 using fasteners 888, which are coupled to braces 881 and which extend through kickboard 10. In some embodiments, the ends of braces 881 are threaded for coupling to fasteners 888. Funnel member 814 may additionally or alternatively be coupled to kickboard 10 using any of the other techniques described herein.

Those skilled in the art will appreciate that the other embodiments of the invention described herein may comprise funnel members which comprise a relatively flexible material and relatively rigid braces.

The description provided above in relation to the additional and/or alternative kickboard and funnel member embodiments depicted in FIGS. 6–13B focusses on the additional and/or alternative features of these embodiments. The kickboards and funnel members of these embodiments may have other characteristics and features which are similar to those of kickboard 10 and funnel member 14 depicted in FIGS. 1–5. The additional and/or alternative kickboards and funnel member embodiments may also operate in substantially the same manner as kickboard 10 and funnel member 14 to create drag, thereby allowing a swimmer to isolate and train the muscles used in kicking.

In some embodiments of the invention, one or more funnel members are provided in the form of a kit for retrofitting an existing kickboard. People may couple a suitable funnel member to their kickboard to form a corresponding channel. Kits according to the invention may comprise funnel members having different ratios of the total cross-sectional areas of their front and rear opening(s), such that a swimmer can change the drag that they experience while using their kickboard device by changing the funnel member that is mounted to the kickboard. Funnel members provided in kits may be preformed with a certain shape or may require that the user deform the funnel member to provide a suitable shape.

As will be apparent to those skilled in the art in the light of the foregoing disclosure, many alterations and modifications are possible in the practice of this invention without departing from the spirit or scope thereof. For example:

The shape of the funnel member and/or channel formed by the funnel member need not be smooth or continuous. In some embodiments, the channel may comprise steps or other discontinuities.

In general, there is no requirement that the rear opening be at the rear of the funnel member or of the channel. In some embodiments, one or more rear opening(s) may be in the sides of the channel or on the bottom surface of the channel. All that is required, in general, is that the rear opening(s) be rearward of the front opening(s).

In any of the embodiments described herein, the kickboard and/or the funnel member and/or parts thereof may be fabricated from a relatively flexible material having one or more air chambers. Air chambers in the funnel member may be inflated with air to provide the funnel member with the desired rigidity and deformability characteristics. Air chambers in the kickboard may be inflated to provide the kickboard with the desired buoyancy characteristics.

The funnel member may comprise additional flanges, scoops, foils or the like which extend in transverse directions. Such devices may extend into the channel or outwardly from the funnel member to provide additional drag. The funnel member may comprise a mechanism for opening, closing and/or varying the size of one or more of its front and/or rear openings to vary the drag created by the funnel member. Such a mechanism may comprise an adjustment member that slides transversely over one or more of the front and/or rear openings of a funnel member for example. In another example, a cover member may be attached to a funnel member using hook and loop fasteners, a "snap together" mechanism or the like to cover one or more of the front and/or rear openings in a funnel member.

Accordingly, the scope of the invention is to be construed in accordance with the substance defined by the following claims.

What is claimed is:

1. A drag-inducing kickboard apparatus comprising;

a buoyant kickboard having a front end tapered in width and a generally flattened upper surface for receiving and supporting the arms or upper body of a swimmer in a prone position, the upper surface free from upward projections that would interfere with a swimmer placing his or her upper body on the upper surface; and a funnel member disposed below an undersurface of the kickboard located opposite the upper surface, the funnel member defining, either itself or in combination with the undersurface of the kickboard, a channel having one or more front openings for allowing water into the channel and one or more rear openings for allowing water to escape from the channel, wherein the one or more front openings are located closer to the tapered front end than the one or more rear openings and wherein the one or more front openings have a total cross-sectional area that is greater than a total cross-sectional area of the one or more rear openings.

2. A kickboard apparatus according to claim 1 wherein the funnel member comprises at least one inner surface that is spaced apart from the undersurface of the kickboard to define the channel between the at least one inner surface of the funnel member and the undersurface of the kickboard.

3. A kickboard apparatus according to claim 2 wherein the at least one inner surface has a curved cross-sectional profile.

4. A kickboard apparatus according to claim 1 wherein the funnel member is sufficiently rigid to maintain a shape of the channel when the funnel member is wet and there is no flow of water through the channel.

5. A kickboard apparatus according to claim 4 wherein the funnel member is sufficiently rigid to maintain the shape of the channel when there is a flow of water through the channel, the flow of water created by a human swimmer.

6. A kickboard apparatus according to claim 1 wherein the funnel member and the kickboard are integrally formed.

7. A kickboard apparatus according to claim 1 wherein the funnel member is formed separately from the kickboard and the funnel member is coupled to the kickboard.

8. A kickboard apparatus according to claim 7 wherein each transverse side of the funnel member comprises one or more flanges which extend along the undersurface of the kickboard.

9. A kickboard apparatus according to claim 8 wherein the funnel member is coupled to the kickboard by one or more fasteners which project through the flanges and into the kickboard.

10. A kickboard apparatus according to claim 8 wherein the funnel member is coupled to the undersurface of the kickboard by adhesive applied between the one or more flanges and the undersurface of the kickboard.

11. A kickboard apparatus according to claim 7 wherein the tunnel member is welded to the undersurface of the kickboard.

12. A kickboard apparatus according to claim 1 comprising a plurality of funnel members, each funnel member defining, either itself or in combination with the undersurface of the kickboard, a corresponding channel having one or more front openings for allowing water into the corresponding channel and one or more rear openings for allowing water to escape from the corresponding channel and wherein, for each funnel member, the one or more front openings have a total cross-sectional area that is greater than a total cross-sectional area of the one or more rear openings.

13. A kickboard apparatus according to claim 1 wherein the channel has a generally rectangular cross-sectional profile.

14. A kickboard apparatus according to claim 1 wherein the channel has a generally triangular cross-sectional profile.

15. A kickboard apparatus according to claim 1 wherein the funnel member comprises a rear surface located rearward of the one or more front openings and the one or more rear openings penetrate the rear surface.

16. A kickboard apparatus according to claim 1 wherein the funnel member comprises a front surface and the one or more front openings penetrate the front surface.

17. A kickboard apparatus according to claim 1 wherein the undersurface of the kickboard is substantially flat.

18. A kickboard apparatus according to claim 1 wherein the undersurface of the kickboard has a curved profile.

19. A kickboard apparatus according to claim 1 wherein the cross-sectional area of the channel decreases monotonically between the one or more front openings and the one or more rear openings.

20. A kickboard apparatus according to claim 1 wherein the funnel member is fabricated from one or more of: plastic, foam, rubber and neoprene.

21. A kickboard apparatus according to claim 1 wherein the funnel member comprises a relatively flexible material and a plurality of relatively rigid braces which are coupled to the relatively flexible material.

22. A kickboard apparatus according to claim 1 wherein the total cross-sectional area of the front openings is in a range of 3–45 square inches.

23. A kickboard apparatus according to claim 1 wherein the total cross-sectional area of the rear openings is in a range of 1–20 square inches.

24. A drag-inducing kickboard apparatus comprising:

a buoyant kickboard; and a plurality of funnel members, each funnel member disposed below an undersurface of the kickboard, the funnel member defining, either itself or in combination with the undersurface of the kickboard, a channel having one or more front openings for allowing water into the channel and one or more rear openings for allowing water to escape from the channel, wherein the one or more front openings have a total cross-sectional area that is greater than a total cross-sectional area of the one or more rear openings and each funnel member comprising at least one corresponding inner surface that is spaced apart from the undersurface to define a corresponding channel between the at least one corresponding inner surface of the funnel member and the undersurface of the kickboard, wherein each funnel member is shaped to provide its corresponding channel with one or more front openings for allowing water into the corresponding channel and one or more rear openings for allowing water to escape from the corresponding channel and wherein, for each funnel member, the one or more front openings have a total cross-sectional area that is greater than a total cross-sectional area of the one or more rear openings.

25. A drag-inducing kickboard apparatus comprising:

a buoyant kickboard; and a funnel member disposed below an undersurface of the kickboard, the funnel member defining, either itself or in combination with the undersurface of the kickboard, a channel having one or more front openings for allowing water into the channel and one or more rear openings for allowing water to escape from the channel, wherein the one or more front openings have a total cross-sectional area that is greater than a total cross-sectional area of the one or more rear openings;

wherein the funnel member comprises a rear surface located rearward of the one or more front openings and the one or more rear openings penetrate the rear surface and wherein the cross-sectional area of the channel is substantially constant between the one or more front openings and the rear surface.

26. A drag-inducing kickboard apparatus comprising:

a buoyant kickboard; and a funnel member disposed below an undersurface of the kickboard, the funnel member defining, either itself or in combination with the undersurface of the kickboard, a channel having one or more front openings for allowing water into the channel and one or more rear openings for allowing water to escape from the channel, wherein the one or more front openings have a total cross-sectional area that is greater than a total cross-sectional area of the one or more rear openings;

wherein the funnel member comprises one or more inflatable cells which may be inflated with air.

27. A kit for providing a kickboard with increased drag, the kit comprising a funnel member that is coupleable to a kickboard having a front end tapered in width and a generally flattened upper surface for receiving and supporting the arms or upper body of a swimmer in a prone position, the upper surface free from upward projections that would interfere with a swimmer placing his or her upper body on the upper surface, wherein, when coupled to the kickboard, the funnel member defines, either itself or in combination with an undersurface of the kickboard, a channel located on an underside of the kickboard opposite the upper surface, the channel having one or more front openings for allowing water into the channel and one or more rear openings for allowing water to escape from the channel, wherein the one or more front openings are located closer to the tapered front end than the one or more rear openings and wherein the one or more front openings have a total cross-sectional area that is greater than a total cross-sectional area of the one or more rear openings.

28. A method for increasing the drag provided by a kickboard, the method comprising:

providing a kickboard having a front end tapered in width and a generally flattened upper surface for receiving and supporting the arms or upper body of a swimmer in a prone position, the upper surface free from upward projections that would interfere with a swimmer placing his or her upper body on the upper surface;

providing a funnel member;

coupling the funnel member to the kickboard in such a manner that the funnel member, either itself or in combination with an undersurface of the kickboard, defines a channel located on an underside of the kickboard opposite the upper surface, the channel having one or more front openings for allowing water into the channel and one or more rear openings for allowing water to escape from the channel;

wherein the one or more front openings are located closer to the tapered front end than the one or more rear openings; and wherein the one or more front openings have a total cross-sectional area that is greater than a total cross-sectional area of the one or more rear openings.

29. A kickboard apparatus comprising a buoyant kickboard having a front end tapered in width and a generally flattened upper surface for receiving and supporting the arms or upper body of a swimmer in a prone position, the upper surface free from upward projections that would interfere with a swimmer placing his or her upper body on the upper surface and a means for increasing a drag provided by the kickboard when the kickboard is propelled through water, the means for increasing drag providing at least one channel located on an underside of the kickboard opposite the upper surface, the channel having an inlet facing the tapered front end and at least one outlet located rearward of the inlet, the inlet having a cross-sectional area greater than that of the outlet.

* * * * *